US010119737B2

(12) United States Patent
Schneider

(10) Patent No.: US 10,119,737 B2
(45) Date of Patent: Nov. 6, 2018

(54) CONTAINER TREATMENT INSTALLATION WITH REFRIGERATION INSTALLATION, AND METHOD FOR STARTING THE OPERATION OF A REFRIGERATION INSTALLATION OF A CONTAINER TREATMENT INSTALLATION

(71) Applicant: KRONES AG, Neutraubling (DE)

(72) Inventor: Juergen Schneider, Neutraubling (DE)

(73) Assignee: KRONES AG, Neutraubling (DE)

( * ) Notice: Subject to any disclaimer, the term of this patent is extended or adjusted under 35 U.S.C. 154(b) by 64 days.

(21) Appl. No.: 15/300,459

(22) PCT Filed: Feb. 24, 2015

(86) PCT No.: PCT/EP2015/053842
§ 371 (c)(1),
(2) Date: Sep. 29, 2016

(87) PCT Pub. No.: WO2015/149997
PCT Pub. Date: Oct. 8, 2015

(65) Prior Publication Data

US 2017/0176071 A1 Jun. 22, 2017

(30) Foreign Application Priority Data

Apr. 2, 2014 (DE) ..... 10 2014 104 709

(51) Int. Cl.
*F25B 45/00* (2006.01)

(52) U.S. Cl.
CPC ..... *F25B 45/00* (2013.01); *F25B 2500/26* (2013.01)

(58) Field of Classification Search
CPC ..... F25B 45/00; F25B 2500/26
See application file for complete search history.

(56) References Cited

U.S. PATENT DOCUMENTS

| | | | | |
|---|---|---|---|---|
| 4,507,931 | A | 4/1985 | Barrow et al. | |
| 2006/0051451 | A1 | 3/2006 | Hutchinson et al. | |
| 2011/0140315 | A1* | 6/2011 | Albrecht | B29C 49/4823 264/523 |

(Continued)

FOREIGN PATENT DOCUMENTS

| | | |
|---|---|---|
| DE | 4123988 | 2/1992 |
| DE | 102004023419 | 12/2005 |

(Continued)

*Primary Examiner* — Cassey D Bauer
(74) *Attorney, Agent, or Firm* — Walter | Haverfield LLP; D. Peter Hochberg; Sean F. Mellino

(57) ABSTRACT

A container treatment installation having a refrigeration installation, and a method for starting the operation of a refrigeration installation of a container treatment installation, are provided. The refrigeration installation comprises a refrigerant vessel for receiving a refrigerant which can be used for cooling a component of the container treatment installation, and a control device for controlling an amount of the refrigerant in the refrigerant vessel such that, after operation of the refrigeration installation, only a predetermined residual amount of refrigerant remains in the refrigerant vessel for the transport of the refrigerant installation, and after the transport of the refrigeration installation, the predetermined residual amount is filled up with a predetermined replenishment amount of refrigerant.

15 Claims, 1 Drawing Sheet

(56) References Cited

U.S. PATENT DOCUMENTS

| | | | | |
|---|---|---|---|---|
| 2011/0219794 | A1* | 9/2011 | Shiba | F25B 45/00 62/125 |
| 2012/0117989 | A1* | 5/2012 | Turney | F25B 45/00 62/115 |

FOREIGN PATENT DOCUMENTS

| | | |
|---|---|---|
| DE | 60108700 | 1/2006 |
| WO | WO8912792 | 12/1989 |
| WO | WO2008066530 | 6/2008 |

* cited by examiner

CONTAINER TREATMENT INSTALLATION WITH REFRIGERATION INSTALLATION, AND METHOD FOR STARTING THE OPERATION OF A REFRIGERATION INSTALLATION OF A CONTAINER TREATMENT INSTALLATION

CROSS REFERENCE TO RELATED APPLICATIONS

This application is a 371 National Stage application of International Application No. PCT/EP2015/053842, filed on Feb. 24, 2015, which claims foreign priority to German (DE) Application Serial No. 10 2014 104 709.5 filed on Apr. 2, 2014, the contents of which are incorporated herein by reference in its entireties.

BACKGROUND OF THE INVENTION

Field of the Invention

The present invention relates to a container treatment installation with a refrigeration installation and a method for starting the operation or bringing into service a refrigeration installation of a container treatment installation.

Description of the Prior Art

A container treatment installation which can be or comprise for example a blow moulding machine, a cleaning machine, a filling machine, a labeling machine, a packaging machine, etc., is employed for example in the beverage industry for manufacturing and/or filling and/or packaging of containers. Containers are in particular cans, glass bottles or plastic bottles. The containers are transported by a transport device to or away from the individual machines of the container treatment installation.

In particular, a filling machine comprises a refrigeration installation for refrigerating a product or parts therefrom which is/are to be filled by the filling machine into a container. Refrigeration installations have to be emptied for exporting them. Specifically, refrigeration installations are affected here, which comprise larger, separately declared refrigerant quantities. As such refrigerant quantities are to be understood refrigerant quantities larger than 12 kg. The installations are filled by the producer for a first installation test (FAT) and have to be emptied thereafter again. Subsequently, the installations are filled with nitrogen. After the export, for recommissioning or restart of operation, the nitrogen has to be removed; the installation has to be evacuated for several hours and has to be filled thereafter by a refrigeration installation manufacturer with refrigerant. When refilling, the evaporating temperature is measured by a manometer and set to the values given by the manufacturer. The refrigerant amount or refrigerant amount results from the given parameters. The refrigerant has to be obtained on site in the country. It is to be assumed that these regulations will apply for more and more countries, also outside of Europe.

Disadvantageous in this regard is that the container treatment installation in the delivered version is not ready to use. For filling the refrigeration installation, it is necessary that a local refrigeration installation manufacturer or a local representative of the manufacturer or a technician of the manufacturer factory has to travel to the site of installation of the plant or installation. For filling the plant or installation again, the technician needs specific equipment like a vacuum pump, refrigerant manometer. Refilling the installation takes from several hours up to one to two days. There arise refilling costs of up to 10,000 EUR per refrigeration installation.

SUMMARY OF THE PRESENT INVENTION

Therefore, it is the object of the present invention to create an improved container treatment installation comprising a refrigeration installation and a method for starting the operation of or bringing into service a refrigeration installation of a container treatment installation which solve the above-mentioned problems and, in particular, enable to bring into service a refrigeration installation and, thus, the container treatment installation faster, more secure and cheaper.

This object is solved by a container treatment installation comprising a refrigeration installation according to claim 1. The refrigeration installation comprises a refrigerant container for receiving a refrigerant useable for refrigerating a component of the container treatment installation, and a control device for controlling an amount of the refrigerant in the refrigerant container such that after an operation of the refrigeration installation only a predetermined residual amount of refrigerant remains in the refrigerant container for a transport of the refrigeration installation, and after the transport of the refrigeration installation, the predetermined residual amount is again filled up with a predetermined replenishment amount of refrigerant.

With the described container treatment installation, evacuating of the refrigeration installation on site by the end consumer is avoided. No specific equipment like a vacuum pump, refrigerant manometer and the like is required. No refrigeration installation manufacturer has to travel on site for bringing the container treatment installation into service and fill the refrigeration installation with refrigerant.

A further advantage lies in that the intricate search on site by the branch office or site manager for refrigerant having the required quality is omitted. Instead, the refrigerant can be sent on as so-called retrofit package. Therewith, the previously mentioned obtaining process for the refrigerant on site is omitted and the quality of the refrigerant is ensured.

Moreover, no waiting times on site for the mounting team occur for filling the refrigeration installation. Further, an inadequate start-up of the refrigeration installation and therewith the container treatment installation can be avoided.

Advantageous further developments of the container treatment installation are given in the dependent claims.

The control device can be a valve positioned at the refrigerant container.

According to an embodiment, the refrigeration installation can further comprise a refrigerant compressor for sucking in the predetermined replenishment amount of refrigerant from a refrigerant reservoir.

There is also the option that the refrigeration installation further comprises a detecting device for detecting the amount of refrigerant in the refrigerant container or in a refrigerant reservoir, in which the predetermined replenishment amount of refrigerant is provided.

It is in particular possible that the refrigeration installation further comprises a further control device for controlling, on the basis of a result of the detecting device, setting the predetermined residual amount in the refrigerant container and/or filling up the predetermined residual amount of refrigerant with the predetermined replenishment amount of refrigerant.

According to one implementation version, the refrigerant reservoir can be a disposable container which is configured for receiving exactly the predetermined replenishment amount of refrigerant.

Possibly, the refrigeration installation serves for refrigerating a gas and/or a liquid, which are/is used in the operation of the container treatment installation.

The container treatment installation can be a filling machine and/or a blow moulding machine or comprise a cleaning machine or a labeling machine.

The above-mentioned object is further solved by a method for a start-up or bringing into service a refrigeration installation of a container treatment installation according to claim 9. The transport method comprises the steps of operating the refrigeration installation at a first mounting place, wherein a refrigerant container receives a refrigerant which is used for refrigerating a component of the container treatment installation, controlling, by a control device, an amount of refrigerant in the refrigerant container such that only a predetermined residual amount of refrigerant remains in the refrigerant container, transporting the refrigeration installation to a second mounting place, and controlling, by the control device, the amount of refrigerant in the refrigerant container such that the predetermined residual amount is again refilled with the predetermined replenishment amount of refrigerant.

The method achieves the same advantages as they are mentioned above as regards the container treatment installation.

Further possible implementations of the invention comprise also combinations of features or styles described above or in the following with reference to the embodiments, even if they are not explicitly mentioned. Herein, the person skilled in the art will also add single aspects as improvements or additions to the respective basic form of the invention.

Further implementations of the invention are subject matter of the embodiments of the invention described in the following.

BRIEF DESCRIPTION OF THE DRAWINGS

In the following, the invention is described in more detail by means of embodiments and with reference to the appended drawing figures, wherein.

In the drawing figures, the same or functionally same elements are provided with the same reference signs unless given otherwise.

DETAILED DESCRIPTION OF THE PRESENT INVENTION

Figure 1:
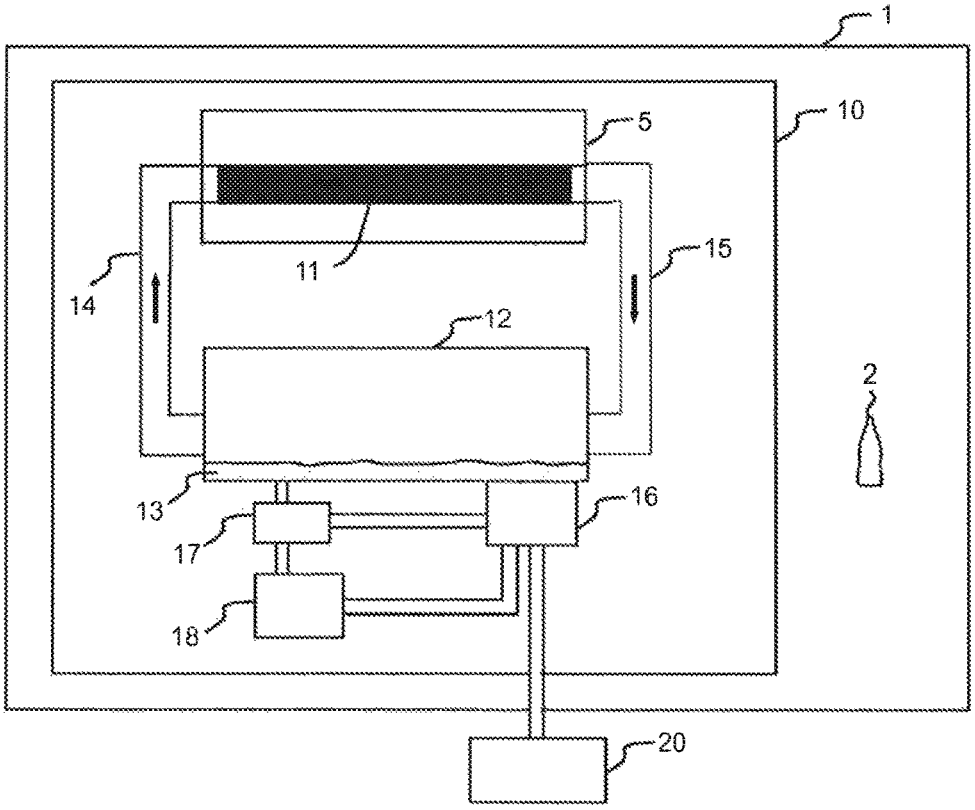
FIG. 1 shows a schematic block diagram of a container treatment installation comprising a refrigeration installation according to a first embodiment.

FIG. 1 shows very schematically a container treatment installation 1 for treating containers 2. The containers 2 can either be finished containers, like glass or plastic bottles, cans, etc. or also preforms. In the container treatment installation 1 in FIG. 1, the containers 2 can be produced out of the preforms. The preforms are manufactured from plastic, like polyethylene terephthalate (PET), polypropylene (PP), etc. and are likewise containers even if still unfinished containers or containers not treated by the container treatment installation 1. The finished containers 2 are in FIG. 1 as an example bottles into which a product can be filled. The product can be in particular a beverage, a detergent, etc.

In FIG. 1, the container treatment installation 1 includes a refrigeration object 5 and a refrigeration installation 10. The refrigeration installation 10 can be filled with refrigerant starting from a refrigerant vessel or refrigerant reservoir 20. The refrigeration object 5 can be, for example, the product or a part thereof, a gas, a liquid, etc.

The refrigeration installation 10 comprises an evaporator 11, a refrigerant container 12 in which a refrigerant 13 is received, a refrigerant line 14 for connecting the refrigerant container 12 to the evaporator 11, a refrigerant line 15 for connecting the evaporator 11 to the refrigerant container 12, the first control device 16, a detecting device 17 and a second control device 18. In the refrigerant reservoir 20, the refrigerant 13 is filled with which the refrigeration installation 10 can be filled. The black bold arrows at the refrigerant lines 14, 15 indicate the direction of the cycle through which the refrigerant 13 runs in a refrigeration installation 10 in the operation of the refrigeration installation 10. Herein, the components of the refrigeration installation 10 are closed to the outside so that a closed cycle results. The refrigerant 13 is in particular liquid when it is filled into the refrigeration installation 10 and/or at room temperature.

The refrigerant installation 10 is shown in FIG. 1 only very schematically and works according to the known principle of refrigeration installations that is not further explained here.

After manufacturing the refrigeration installation 10, the refrigeration installation 10 is filled entirely with the refrigerant 13 at the manufacturer of the refrigeration installation 10 for performing a first test of the refrigeration installation 10. Thereafter, the refrigeration installation 10 is not emptied completely. It remains a predetermined residual amount of refrigerant 13 in the refrigeration installation 10, as illustrated in FIG. 1. The predetermined residual amount of refrigerant 13 results therefrom that only a small part of the refrigerant container 12 in FIG. 1 is filled with refrigerant 13. The predetermined residual amount of refrigerant 13 is, for example smaller than 0.5 kg. The predetermined residual amount is in particular so small that it can be exported without problems.

Thereafter, the refrigerant installation 10 is transported to another location, for example, the final mounting location of the refrigeration installation 10 or a testing laboratory, etc. and is mounted there. Subsequently, directly when performing a start-up or bringing the refrigeration installation 10 into service, a predetermined replenishment amount of refrigerant 13, in particular in liquid state, can be filled into the refrigeration installation 10 by a first control device 16 which is implemented preferably as a valve. The predetermined replenishment amount corresponds to the amount which can be filled in FIG. 1 still in addition to the predetermined residual amount into the refrigerant container 12. It can be determined by the detecting device 17 whether the sufficient of refrigerant 13 was filled into the refrigerant installation 10. The detecting device 17 can be implemented as a scale, as flow meter, etc.

Therewith, evacuating the refrigeration installation 10 on site by the end consumer is omitted. Further, no specific equipment, like a vacuum pump, a refrigerant manometer, is required. No refrigeration installation manufacturer has to travel on site for the start-up or bringing the refrigeration installation 10 into service and to fill it. The intricate search on site by the branch office or site manager for refrigerant 13 perfect in quality is omitted. No waiting times on site occur for the mounting team and an inadequate start-up of the refrigeration installation 10 can be avoided.

The refrigerant 13 can be sent on as retrofit package and, therewith, the procurement of the refrigerant 13 on site can be omitted and the quality of the refrigerant 13 is secured. The refrigerant 13 can be filled by an instructed technician of the manufacturer of the refrigeration installation 10 and/or the container treatment installation 1.

Thus, it is secured in the present embodiment that the refrigeration installation 10 and, therewith, the container treatment installation 1 can be brought into service quickly, securely and cheaply.

According to a modification of the present embodiment, the refrigerant 13 can be sent on in a disposable container as refrigerant reservoir 20 adapted to the delivered refrigeration installation 10. That means, in this case the refrigerating reservoir 20 comprises exactly the replenishment amount which is required to fill up the residual amount of refrigerant 13 in the refrigeration installation 10 to the operating amount of refrigerant 13 in the refrigeration installation 10. Also the refrigerant 13 from the disposable container could be filled into the refrigeration installation 10 by an instructed technician of the manufacturer of the refrigeration installation 10 and/or the container treatment installation 1.

Figure 2:
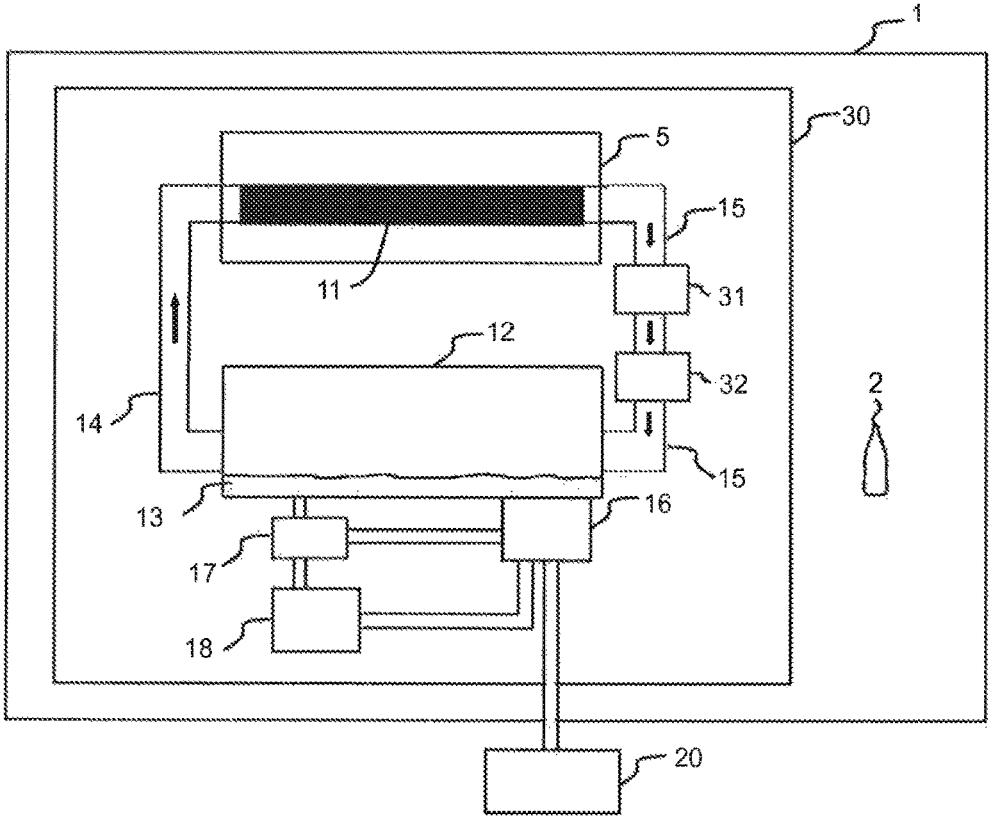
FIG. 2 shows a schematic block diagram of a container treatment installation comprising a refrigeration installation according to a second embodiment.

FIG. 2 shows a refrigeration installation 30 according to a second embodiment. The refrigeration installation 30 according to the second embodiment is implemented in most parts as the refrigeration installation 10 according to the first embodiment. Therefore, only the differences between the both embodiments are described in the following.

As a difference to the first embodiment, the refrigeration installation 30 comprises in the present embodiment a refrigerant compressor 31 with which the refrigerant 13 is compressed and therewith compacted. Moreover, the refrigeration installation 30 comprises an evaporator 32 for evaporating the refrigerant 13. Thus, the refrigerant 13 in the refrigerant container 12 is again in liquid state.

Thus, in the start-up of the refrigeration installation 10 in the present embodiment, the refrigerant 13 can be filled into the refrigeration installation 10 or be sucked by the refrigerating compressor 19 out of the refrigerant reservoir 20 into the refrigeration installation 10. Also here, the refrigerant reservoir 20 can either be a refrigerant bottle or a disposable container prefilled exactly in view of the refrigeration installation 10. Also in the present embodiment, it can be determined by the detecting device 17 whether the sufficient amount of refrigerant was filled in. The detecting device 17 can again be implemented, for example, as scale, as flowmeter, etc.

Thus, in the first and second embodiments is described a method for refilling of refrigeration installations 10, 30 of a container treatment installation 1, which are emptied for the transport.

All of the above-described implementations of the container treatment installation 1, the refrigeration installation 10 and the above-described method can be used separately or in all possible combinations thereof. The features of the first and second embodiments and/or the modifications can be combined arbitrarily. Moreover, in particular, the following modifications are conceivable.

The elements shown in the figures are depicted schematically and can differ in the specific implementation from the forms shown in the figures provided that the above-described functions are guaranteed. The transport direction of the containers 2 is further shown only as an example and can also be vice-versa.

A container treatment installation 1 of the first or second embodiment can also be used for treating glass bottles. Further, the container treatment installation 1 can have positioned directly in a row one after another a blow moulding machine, a cleaning machine, a tilling machine, a labeling machine, etc. In addition, transport devices can be employed between the individual machines.

The container treatment installation 1 of the first or second embodiment can also comprise more than one refrigeration installation 10 and/or one refrigeration installation 30.

The refrigeration installation 10 according to the first embodiment can be a compression or sorption refrigeration installation.

The invention claimed is:

1. A container treatment installation connectable to a refrigerant reservoir and comprising a refrigeration installation, the refrigeration installation comprising a refrigerant container for receiving a refrigerant useable for refrigerating a component of the container treatment installation, and a detecting device for detecting an amount of the refrigerant in a selected one of the group consisting of the refrigerant container and the refrigerant reservoir and yielding a detecting result, a control device for controlling an amount of the refrigerant in the refrigerant container on the basis of the detecting result of the detecting device, wherein the control device is configured to perform a control adjustment, wherein after an operation of the refrigeration installation only a predetermined residual amount of refrigerant remains in the refrigerant container for a transport of the refrigeration installation, and after the transport of the refrigeration installation, the predetermined residual amount is again filled up with a predetermined replenishment amount of refrigerant, wherein the predetermined replenishment amount of refrigerant corresponds to an amount which can be filled in addition to the predetermined residual amount of refrigerant into the refrigerant container to bring the refrigeration installation into service so that evacuating of the refrigeration installation at the second mounting place is avoided, and wherein the control device is configured to control the amount of refrigerant in the refrigerant container on the basis of a detecting result of the detecting device which detects the amount of the refrigerant in the refrigerant reservoir when refilling the predetermined replenishment amount of refrigerant into the refrigerant container.

2. The container treatment installation according to claim 1, wherein the control device is a valve positioned at the refrigerant container.

3. The container treatment installation according to claim 1, wherein the refrigeration installation further comprises a refrigerant compressor for sucking in the predetermined replenishment amount of refrigerant from the refrigerant reservoir.

4. The container treatment installation according to claim 1, wherein the refrigeration installation further comprises a further control device for controlling a selected one of the group consisting of setting the predetermined residual amount in the refrigerant container and filling up the predetermined residual amount of refrigerant in the refrigerant container with the predetermined replenishment amount of refrigerant.

5. The container treatment installation according to claim 3, wherein the refrigerant reservoir is a disposable container which is configured for receiving exactly the predetermined replenishment amount of refrigerant.

6. The container treatment installation according to claim 1, wherein the refrigeration installation serves for refrigerating at least one refrigerant selected from the group consisting of a gas and a liquid, which gas and liquid being used in the operation of the container treatment installation.

7. The container treatment installation according to claim 1, wherein the container treatment installation is selected from the group consisting of at least one of the group consisting of a filling machine, and a blow moulding machine, and selected from the group consisting of a cleaning machine and a labeling machine.

8. A method for bringing into service a refrigeration installation of a container treatment installation, the transport method comprises the steps of:

operating the refrigeration installation at a first mounting place, wherein a refrigerant container receives a refrigerant used for refrigerating a component of the container treatment installation, detecting by a detecting device of the refrigeration installation, an amount of refrigerant selected from the group consisting of the refrigerant container and the refrigerant reservoir, controlling, by a control device, an amount of refrigerant in the refrigerant container in response to the detecting step such that only a predetermined residual amount of refrigerant remains in the refrigerant container, transporting the refrigeration installation to a second mounting place, and controlling, by the control device, the amount of refrigerant in the refrigerant container such that the predetermined residual amount is again refilled with a predetermined replenishment amount of refrigerant, wherein the predetermined replenishment amount of refrigerant corresponds to an amount which can be filled in addition to the predetermined residual amount of refrigerant into the refrigerant container to bring the refrigeration installation into service so that evacuating of the refrigeration installation at the second mounting place is avoided, and wherein the control device controls the amount of refrigerant in the refrigerant container on the basis of a detecting result of the detecting device which detects the amount of the refrigerant in the refrigerant reservoir when refilling the predetermined replenishment amount of refrigerant into the refrigerant container.

9. The method according to claim 8, further comprising the step of sucking the predetermined replenishment amount of refrigerant by a refrigerant compressor out of the refrigerant reservoir which is configured for receiving exactly the predetermined replenishment amount of refrigerant.

10. The method according to claim 8, wherein the control device is a valve positioned at the refrigerant container, wherein the controlling step is performed by opening and closing the valve to take refrigerant out of the refrigerant container or to refill the refrigerant container with refrigerant.

11. The method according to claim 8, wherein a refrigerant compressor of the refrigeration installation sucks in the predetermined replenishment amount of refrigerant from the refrigerant reservoir.

12. The method according to claim 8, wherein a further control device of the refrigeration installation is responsive to the result of the detecting device for controlling the setting of a select one of the group consisting of the predetermined residual amount in the refrigerant container and the filling up the predetermined residual amount of refrigerant with the predetermined replenishment amount of refrigerant.

13. The method according to claim 11, wherein the refrigerant reservoir is a disposable container, and wherein the disposable container receives exactly the predetermined replenishment amount of refrigerant.

14. The method according to claim 8, wherein the refrigeration installation refrigerates at least one refrigerant of the group consisting of a gas and a liquid, which gas and/or liquid are/is used in the operation of the container treatment installation.

15. The method according to claim 8, wherein the container treatment installation is a selected one of the group consisting of a filling machine, and a blow moulding machine, or wherein the container treatment installation comprises a cleaning machine or a labeling machine.

* * * * *